US007194229B2

(12) United States Patent
Ishii

(10) Patent No.: US 7,194,229 B2
(45) Date of Patent: Mar. 20, 2007

(54) METHOD AND APPARATUS FOR FORMING SUPERIMPOSED TONER IMAGES OF A PLURALITY OF COLORS

(75) Inventor: Koichi Ishii, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/234,089

(22) Filed: Sep. 26, 2005

(65) Prior Publication Data

US 2006/0067740 A1 Mar. 30, 2006

(30) Foreign Application Priority Data

Sep. 28, 2004 (JP) ..... 2004-282613

(51) Int. Cl.
*G03G 15/10* (2006.01)

(52) U.S. Cl. ..... 399/249; 399/128; 399/233; 399/296; 399/345; 399/348; 399/357

(58) Field of Classification Search ..... 399/249, 399/237, 222, 40, 223, 224, 128, 129, 134, 399/233, 231, 296, 345, 348, 357
See application file for complete search history.

(56) References Cited

U.S. PATENT DOCUMENTS 4,728,983 A 3/1988 Zwadlo et al.
5,754,928 A * 5/1998 Moe et al. ..... 399/249
5,835,826 A * 11/1998 Okada et al. ..... 399/249
6,493,530 B2 * 12/2002 Ishii et al. ..... 399/237
2002/0110390 A1 * 8/2002 Park et al. ..... 399/237
2002/0136569 A1 * 9/2002 Ahn et al. ..... 399/237

FOREIGN PATENT DOCUMENTS

JP 2001-83806 3/2001
JP 2002-108107 4/2002
JP 2003-341290 12/2003

* cited by examiner

*Primary Examiner*—David M. Gray
*Assistant Examiner*—Geoffrey T Evans
(74) *Attorney, Agent, or Firm*—Oblon, Spivak, McClelland, Maier & Neustadt, P.C.

(57) ABSTRACT

When superimposing toner images of a plurality of colors on an image supporting member to form a color image, a free phase ion in a precedent image is removed without distorting the toner image precedently formed on the image supporting member, thereby improving reproducibility of image dots of the toner images having second and subsequent colors to obtain a high-definition color image with high contrast.

14 Claims, 5 Drawing Sheets

METHOD AND APPARATUS FOR FORMING SUPERIMPOSED TONER IMAGES OF A PLURALITY OF COLORS

CROSS-REFERENCE TO RELATED APPLICATIONS

This application is based upon and claims the benefit of priority from prior Japanese Patent Application No. 2004-282613, filed Sep. 28, 2004, the entire contents of which are incorporated herein by reference.

BACKGROUND OF THE INVENTION

1. Field of the Invention

The present invention relates to an image forming apparatus and an image forming method which form a toner image by using a liquid developer, and more particularly to an image forming apparatus and an image forming method which superimpose toner images of a plurality of colors on an image supporting member to obtain a color image.

2. Description of the Related Art

In an image forming system which obtains a toner image by an electrophotographic scheme using a liquid developer including toner particles and a carrier liquid, it is possible to use very fine toner particles of a submicron size as compared with, e.g., a one-component development mode (non-liquid). Using fine toner particles provides advantages of, e.g., an improvement in an image quality or realization of a texture comparable to printing (e.g., offset printing). Further, this image forming mode is cost-effective since a sufficient image concentration can be obtained with a small amount of toner, and is an energy-saving type because it can perform fixing (of toner) on a paper sheet at a relatively low temperature.

In case of obtaining a color image by an image forming apparatus which is of such an electrophotographic type using a liquid developer, there is a method which superimposes toner images of a plurality of colors on a photoconductor to obtain a color image and then collectively transfers the color image on the photoconductor onto a transfer target material. The collective transfer method has an advantage of a high positioning accuracy between colors and acquisition of a high-quality image. On the other hand, in the collective transfer method, since an image forming step is repeated on a photoconductor having a toner image, it is known that reproducibility of a image dot tends to be deteriorated at the image forming step of second and subsequent colors as compared with an image of a first color.

It can be considered that this phenomenon occurs because a charge imparting agent such as a metallic soap contained in a carrier liquid used in a liquid developer serves as an ion component (a counter ion) to be usually trapped and present in toner particles (including a "coloring agent"), but the charge imparting agent partly dissociates itself from the toner particles to freely behave mainly as a free phase ion.

As a method of removing such a free phase ion, removing an excess carrier liquid on a photoconductor before an image forming step of second and subsequent colors is proposed in Jpn. Pat. Appln. KOKAI publication No. 2002-108107 (p. 4, FIG. 1). That is, a method of removing a free phase ion described in the above-described publication uses a squeeze roller to decrease a carrier liquid contained in a precedent toner image having developed image dots on a photoconductive drum surface, and utilizes a drying device to lower a level of residual of the carrier liquid, thereby reducing the free phase ion.

However, in the method disclosed in the above-described publication, if adherence of toner particles of a preceding toner image with respect to a photoconductive surface is weak in a step of removing the free phase ion, the toner image (precedently formed on the photoconductive drum) may be possibly distorted (the toner particles may be possibly moved).

In order to avoid such distortion of a precedent toner image, for example, Jpn. Pat. Appln. KOKAI publication No. 2003-341290 proposes a method which allows toner particles to adhere to a photoconductive surface by set charging from an charger for the purpose of increasing adherence of the toner particles of a preceding toner image with respect to the photoconductive surface after end of development of the preceding toner image and before an image forming step of second and subsequent colors.

However, in the above-described method using set charging, a charger requiring a high voltage must be newly provided. This is nothing more than an obstacle for energy saving. Furthermore, in a color image forming apparatus in which a plurality of image forming units are provided around a photoconductor and toner images of a plurality of colors are superimposed during one revolution of the photoconductor, a charger for set charging is required for each image forming unit, and hence an installation space for each charger is necessary, which of course results in an increase in size.

BRIEF SUMMARY OF THE INVENTION

It is an object of the present invention to provide an image forming apparatus and an image forming method which avoid distortion of a precedent toner image when superimposing the toner images of a plurality of colors on a photoconductor, maintain image dot reproducibility of the toner images of second and subsequent colors to obtain a high-grade color image, and are capable of saving an energy and reducing an apparatus size.

According to an aspect of the present invention is to provide a color image forming apparatus comprising:

an image supporting member which includes a photoconductive layer configured to hold an electrostatic latent image;

a first image forming section, arranged around the image supporting member, which forms and visualizes an electrostatic latent image on the photoconductive layer to form a first developed image, the first image forming section having a charging device which gives a first potential to the photoconductive layer, an exposure device which forms a first electrostatic latent image corresponding to an image of a first color on the photoconductive layer, and a development device which supplies a developer of the first color to the first electrostatic latent image to form a first developed image;

a second image forming section, arranged around the image supporting member, which forms and visualizes an electrostatic latent image formed on the photoconductive layer to form a second developed image, the second image forming section having a charging device which gives a second potential to the photoconductive layer, an exposure device which forms a second electrostatic latent image corresponding to an image of a second color on the photoconductive layer, and a development device which supplies a developer of the second predetermined color to the second electrostatic latent image to form a second developed image at least partially overlapping the first developed image; and a carrier liquid quantity reducing device which is arranged around the image supporting member, and removes part of a carrier liquid contained in the first developed image formed by the first image forming section after a second charging with the charging device of the second image forming section and before the second developed image is formed by the second image forming section.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments according to the present invention will now be described hereinafter with reference to the accompanying drawings. The present invention is characterized by uniformly charging a photoconductive drum having a precedent toner image formed in accordance with image dots for the next image forming step and then superimposing the next image with high contrast on the preceding toner image without distorting the preceding toner image when exposing the next image while reducing a quantity of a carrier liquid on a photoconductive drum surface.

Figure 1:
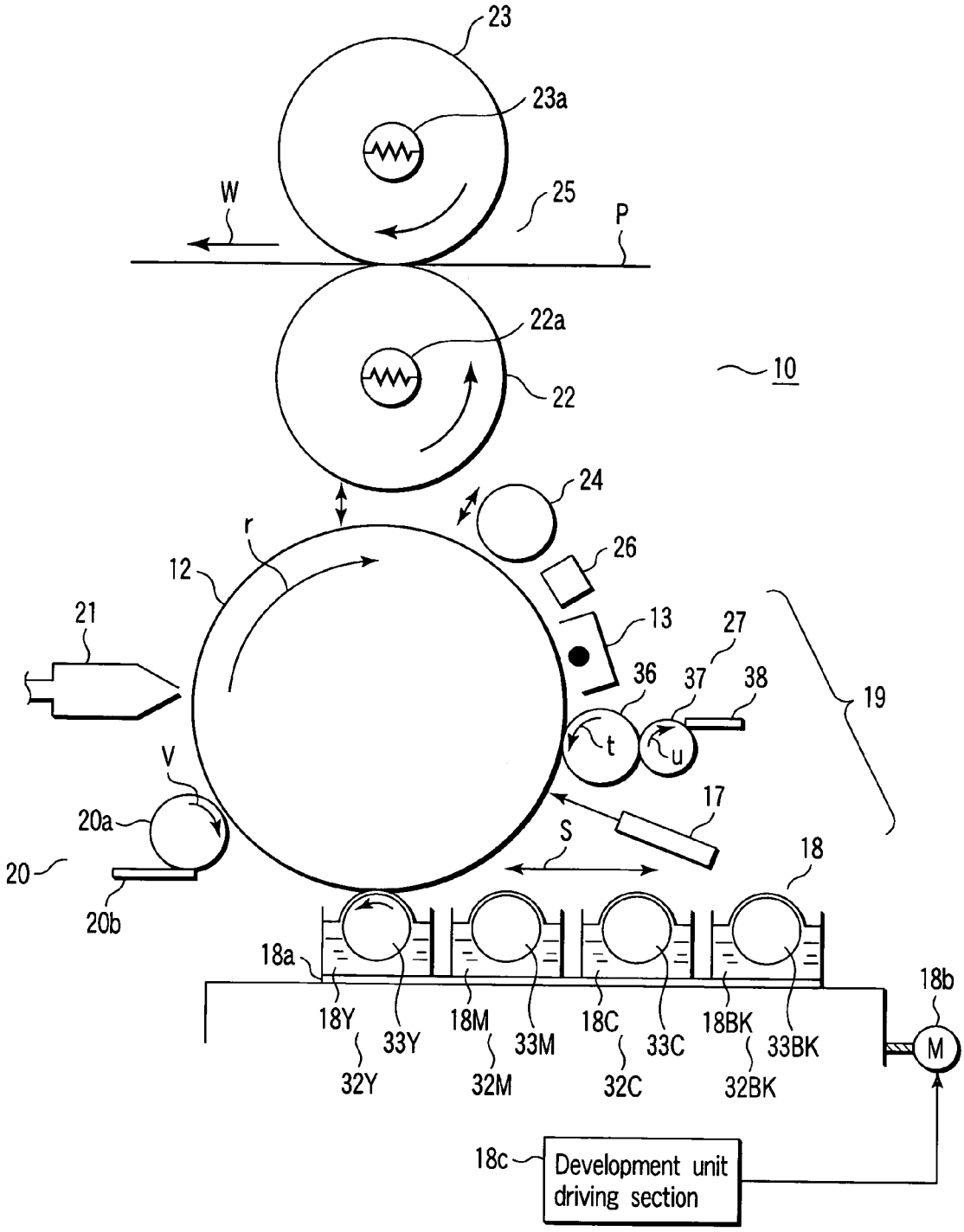
FIG. 1 is a schematic view showing an example of an image forming section of a color electrophotographic apparatus.

FIG. 1 shows an image forming section of an image forming apparatus 10. A photoconductive drum 12 as an image supporting member has a configuration in which an organic-based or amorphous-silicon-based photoconductive layer having a thickness of 10 to 40 μm is formed on an electroconductive metal drum of, e.g., aluminum. It is to be noted that a protective layer formed of a fluorine-based resin or a silicone-based resin with a thickness of 5 μm or below may be preferably provided on the photoconductive layer. Moreover, the electroconductive metal drum of the photoconductive drum 12 is grounded. It is to be noted that the photoconductive drum 12 may demonstrate insulating properties and have a configuration in which a film or the like having a photoconductive layer and an electroconductive layer formed thereon is fixed on a peripheral surface of the photoconductive drum 12.

A charging device 13, a carrier liquid absorbing device 27, an exposure device 17 and a development unit 18 are sequentially provided around the photoconductive drum 12 along a rotating direction of the photoconductive drum 12 indicated by an arrow r. They will be referred to as an image forming unit 19 hereinafter.

The charging device 13 is, e.g., a solid-state charger such as a known scorotron or an ion generator, and uniformly charges a surface of the photoconductive drum 12 to, e.g., approximately +800 V.

The exposure device 17 is, e.g., a solid-state head such as an LED exposure device which involves scanning in a main scanning direction like a laser exposure device, can perform selective exposure with respect to the photoconductive drum 12, and attenuates a potential in an exposed region to, e.g., approximately +200 V to form an electrostatic latent image.

The development unit 18 includes four development devices 32Y to 32BK holding four color liquid developers 18Y to 18BK of yellow (Y), magenta (M), cyan (C) and black (BK) for manifesting the electrostatic latent image. A development bias voltage of, e.g., +600 V is applied to development rollers 33Y to 33BK which supply the liquid developers 18Y to 18BK in the respective development devices 32Y to 32BK to the surface of the photoconductive drum 12, and these rollers face the surface of the photoconductive drum 12 with a gap of approximately 100 μm therebetween. A development unit stage 18*a* is reciprocated by a development unit moving mechanism 18*b* in a direction indicated by an arrow s. It is to be noted that movements (positions) of the respective development devices 32Y to 32BK by the development unit moving mechanism 18*b* are set by a development unit driving section 18*c*.

The liquid developers 18Y to 18BK have toner particles with a particle diameter of 1 μm or below containing at least a resin component and a coloring component, the toner particles being dispersed in a nonpolar carrier liquid such as Isopar L (by Exxon Mobile Chemical Corporation). It is to be noted that an electric charge imparting agent such as a metallic soap is added in the liquid developers 18Y to 18BK at a predetermined ratio. Additionally, the electric charge imparting agent is usually trapped in the toner particles as an ion component. As the coloring component, it is possible to use an arbitrary dye component or pigment. The resin component is not particularly restricted as long as it is a resin which is insoluble in an insulating carrier liquid which is a solvent.

The carrier liquid absorbing device 27 as a carrier liquid quantity reducing device is provided between the charging device 13 and the exposure device 17, the carrier liquid absorbing device 27 absorbing and removing the carrier liquid of a preceding toner image which has been already formed on the surface of the photoconductive drum 12 when forming toner images of second and subsequent colors.

The carrier liquid absorbing device 27 includes a porous absorbing roller 36 which rotates in a direction indicated by an arrow t and a cleaning roller 37 which is rotated in a direction indicated by an arrow u. It is to be noted that the cleaning roller 37 is formed of a metal such as aluminum or stainless or an insulating rigid body whose surface has been subjected to conduction processing. A blade 38 is brought into contact with a predetermined position of the cleaning roller 37 with a predetermined pressure. As the blade 38, an elastic material such as urethane rubber is suitable.

Figure 2:
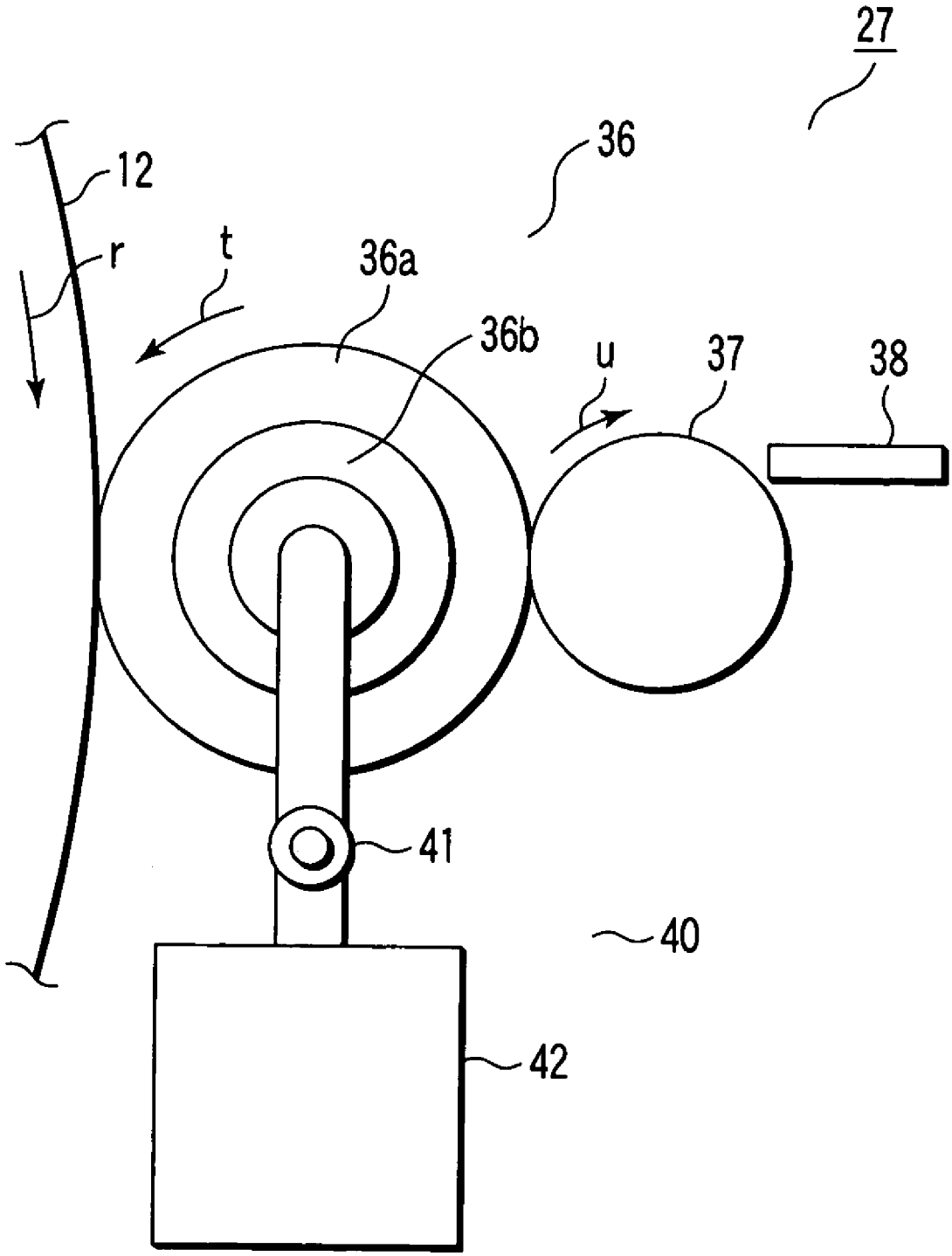
FIG. 2 is a schematic view showing an example of a carrier liquid absorbing device which can be used in the image forming section depicted in FIG. 1.

As shown in FIG. 2, the absorbing roller 36 has a configuration in which a metal core 36*b* is covered with a porous elastic member 36*a*. A voltage which is substantially equivalent to a surface potential of the photoconductive drum 12 charged by the charging device 13, e.g., +800 V is applied to a surface of the absorbing roller 36.

The porous elastic member 36*a* has a flat and smooth configuration in which holes having a diameter of approximately 30 μm are uniformly dispersed. The porous elastic member 36*a* can be formed of, e.g., a rubber-based material such as polyurethane sponge or a fine porous sheet as typified by Gore-Tex or the like. A surface of the porous elastic member 36*a* is at least subjected to electroconductive processing so that it demonstrates electroconductive properties (electroconductive properties are provided to the surface of the porous elastic member 36*a*). The metal core 36*b* is formed of a hollow shaft obtained by laminating and sintering a sintered metal or a metal mesh, or has a configuration in which many through holes are simply provided to a hollow metal shaft in order to assure air permeability.

The absorbing roller 36 is connected with a carrier liquid collecting device 40 through the metal core 36*b*. The carrier liquid collecting device 40 includes a pump 41 which generates a negative pressure in the hollow shaft of the metal core 36*b* and a collection container 42 which holds the collected carrier liquid, and sucks and holds the carrier liquid absorbed by the porous elastic member 36*a* of the absorbing roller 36.

Since the carrier liquid absorbing device 27 absorbs and removes the carrier liquid of a preceding toner image when forming toner images of second and subsequent colors, it is retracted at a predetermined position in order to avoid contact with the surface of the photoconductive drum 12 when forming a toner image of a first color, i.e., yellow (Y). It is to be noted that the carrier liquid absorbing device 27 may be brought into contact with the surface of the photoconductive drum 12 even at the time of forming the toner image of the first color, i.e., yellow (Y).

A squeeze device 20 which eliminates overlapping of a toner image on the photoconductive drum 12 and forms a thin film of (removes) the carrier liquid is positioned on the downstream side of the development unit 18 around the photoconductive drum 12. The squeeze device 20 has a squeeze roller 20*a* and a squeeze blade 20*b*. The squeeze roller 20*a* is, e.g., a metal cylinder column and arranged to face the surface of the photoconductive drum 12 with a gap of 50 μm or below therebetween. The squeeze roller 20*a* is rotated in a region facing the surface of the photoconductive drum 12 in a direction of an arrow v opposite to the surface of the photoconductive drum 12 so that a surface speed becomes approximately three times a speed of moving the surface of the photoconductive drum 12.

The carrier liquid in an upper layer portion on the surface of the photoconductive drum 12 is mainly carried from a facing position (with respect to the surface of the drum 12) toward the downstream side by a fluid squeezing effect due to rotation of the squeeze roller 20*a*. As a result, a predetermined quantity of the carrier liquid on the surface of the photoconductive drum 12 is removed. Consequently, a film thickness of the carrier liquid on the surface of the photoconductive drum 12 is reduced to 3 μm or below from, e.g., approximately 30 μm immediately after development. However, a free phase ion still exists in a non-image region such as a background portion irrespective of a reduction in a film thickness of the carrier liquid on the surface of the photoconductive drum 12.

The carrier liquid removed by the squeeze roller 20*a* is collected by the squeeze blade 20*b*.

A drying device 21 which blows air toward the surface of the photoconductive drum 12 (and a toner image positioned on the surface of the same) to dry the excess carrier liquid on the photoconductive drum 12 before transfer, a transfer device 25 which transfers a toner image formed on the photoconductive drum 12 onto a paper sheet P which is a sheet type output medium, a photoconductor cleaner 24 which collects the residual toner remaining on the surface of the photoconductive drum 12, a charge removing device 26 which eliminates residual charge remaining on the surface of the photoconductive drum 12, and others are arranged around the photoconductive drum 12 on the downstream side of the development unit 18.

The drying device 21 provides a gas for drying the carrier liquid on the photoconductive drum 12 from the nozzle connected with a blower or the like to the photoconductive drum 12. The gas for drying can use an air having an ambient temperature or the heated air.

The transfer device 25 includes an intermediate transfer roller 22 having an elastic layer formed on a roller-shaped substrate surface and a heater 22*a* provided therein, and a pressure roller 23 having a heater 23*a* provided therein. Since the transfer device 25 collectively transfers toner images onto the paper sheet P in a state where the toner images of four colors are superimposed, the intermediate transfer roller 22 is retracted at a retracted position where it does not come into contact with the surface of the photoconductive drum 12 in image forming steps of the first to third colors. The intermediate transfer roller 22 is pushed against the photoconductive drum 12 by a non-illustrated driving mechanism so that the intermediate transfer roller 22 is brought into contact with the surface of the photoconductive drum 12 with pressure during an image forming step of the fourth color.

The photoconductor cleaner 24 is, e.g., a porous elastic roller, and removes the residual toner (on the surface of the drum 12) when brought into contact with the surface of the photoconductive drum 12.

The charge removing device 26 eliminates residual charge remaining in the photoconductive layer on the surface of the photoconductive drum 12, and it is possible to use as the charge removing device 26, e.g., a device which outputs light like a halogen lamp or an LED or a device which supplies electric charge having a counter polarity of the polarity of the residual charge or including an alternating-current component.

The photoconductor cleaner 24 and the charge removing device 26 are effected after end of transfer of toner images by the transfer device 25. Therefore, the photoconductor cleaner 24 is positioned at retracted positions where they are not in contact with the surface of the photoconductive drum 12 by a non-illustrated retracting mechanism (a pushing mechanism) during image formation of the first to third colors. That is, the photoconductor cleaner 24 is brought into contact with the surface of the photoconductive drum 12 at a timing of transferring toner images by the transfer device 25, and the charge removing device 26 is operated in synchronization with this movement or at a predetermined timing.

An effect will now be described.

When an image forming process begins, the transfer device 25 and the photoconductor cleaner 24 are positioned (at retracted positions) so that they are not in contact with the surface of the photoconductive drum 12 and a non-operating state of the drying device 21 and the charge removing device 26 is maintained until a color toner image is obtained by superimposing toner layers of yellow (Y), magenta (M), cyan (C) and black (BK) on the surface of the photoconductive drum 12. In such a state, the photoconductive drum 12 is rotated in the direction indicated by the arrow r, and a toner image of yellow (Y) is formed on the surface of the photoconductive drum 12 in one revolution.

In detail, when the photoconductive drum 12 is rotated in the direction indicated by the arrow r, the surface of the photoconductive drum 12 is uniformly charged to approximately +800 V by the charging device 13. After this charging, the photoconductive drum 12 is selectively irradiated with exposure light modulated based on image information of yellow by the exposure device 17 without operating the carrier liquid absorbing device 27, thereby forming an electrostatic latent image of yellow with which an image area is attenuated to approximately +200 V. That is, at the time of forming the toner image of yellow, the carrier liquid absorbing device 27 is positioned at the (non-contact) retracted position where it is not in contact with the surface of the photoconductive drum 12.

In the development unit 18, the development unit stage 18*a* is moved in the direction indicated by the arrow t with movement of the development unit moving mechanism 18*b* in the direction indicated by the arrow t based on control by the development unit driving section 18*c* so that the development roller 33Y of yellow (Y) faces a development position.

The liquid developer 18Y is supplied to the electrostatic latent image of yellow formed on the surface of the photoconductive drum 12 by the development roller 33Y to which a development bias voltage of approximately +600 V is applied. As a result, the toner image of the first color yellow (Y) is formed on the surface of the photoconductive drum 12. At this moment, a potential of an image area (an image dot) to which toner particles are supplied is increased to, e.g., approximately +300 V.

The yellow toner image on the surface of the photoconductive drum 12 is formed as a thin layer having a carrier liquid thickness of approximately 3 μm or below by the squeeze device 21. In the image area of the yellow toner image, the toner particles forming the image are pushed against the surface of the photoconductive drum 12. However, in a non-image region, since the free phase ion still exists, a surface resistance value is substantially lowered.

Subsequently, a toner image of a second color magenta (M) is formed on the toner image of yellow (Y) in a second revolution of the photoconductive drum 12. This time, the carrier liquid absorbing device 27 is brought into contact with the surface of the photoconductive drum 12 in order to absorb and remove the carrier liquid of the precedently formed yellow toner image.

In formation of the toner image of magenta (M), the photoconductive drum 12 is, therefore, uniformly charged to approximately +800 V on the toner image of yellow (Y) by the charging device 13 in accordance with subsequent revolutions indicated by the arrow r. By charging of this charging device 13, at the same time, the toner particles of the toner image of yellow (Y) are pushed in a direction of a substrate (a metal support) of the photoconductive drum 12 by set charge directed toward the surface of the photoconductive drum 12. As a result, the yellow toner image already formed on the surface of the photoconductive drum 12 is charged to, e.g., approximately +700 V.

Subsequently, the carrier liquid included in the toner image of yellow (Y) on the photoconductive drum 12 is reduced by the carrier liquid absorbing device 27. That is, when the surface of the photoconductive drum 12 is moved in a state where the carrier liquid absorbing device 27 is in contact with the photoconductive drum 12, the carrier liquid included in the yellow toner image is partially absorbed by a capillary force (a capillary phenomenon) of a plurality of holes provided to the porous elastic member 36*a* of the absorbing roller 36, and guided to the metal core 36*b*. The carrier liquid guided to the metal core 36*b* is collected into the collection container 42 (through the metal core 36*b*).

At this time, when the carrier liquid existing in a non-image region in particular is absorbed, a large part of the free phase ion aboundingly contained in the carrier liquid in the non-image region is also removed.

Since a voltage equivalent to the potential of the surface of the photoconductive drum 12, e.g., +800 V is applied to the surface of the absorbing roller 36, the surface of the photoconductive drum 12 is maintained at a predetermined potential (a charging potential) irrespective of contact of the absorbing roller 36. It is to be noted that the toner particles of the yellow toner image are pushed against the substrate (the metal support) of the photoconductive drum 12 by a voltage of the surface of the absorbing roller 36. Therefore, the toner particles of the yellow toner image are not drawn (peeled off) from the surface of the photoconductive drum 12 toward the absorbing roller 36 side to deteriorate an image quality irrespective of contact of the absorbing roller 36.

It is to be noted that there is a possibility that toner particles, the quantity of which does not affect an image quality, adhere to the absorbing roller 36. However, the toner particles which have adhered to the absorbing roller 36 are removed by the cleaning roller 37 and mechanically scraped off by the blade 38.

In this manner, a predetermined quantity of the carrier liquid contained in the image portion (the toner layer) of the yellow toner image is reduced by the carrier liquid absorbing device 27 to enter a state in which there is seemingly almost no carrier liquid in the non-image region. At this time, almost all of the free phase ion is removed together with the carrier liquid.

Then, the surface of the photoconductive drum 12 is selectively irradiated with exposure light modulated based on image information of magenta (M) by the exposure device 17 so that the exposure light is superimposed on the yellow toner image. As a result, an electrostatic latent image of magenta (M) is formed.

At the time of exposure of the image information of magenta (M), since a quantity of the carrier liquid is reduced and almost all of the free phase ion is removed in the non-image area in particular, the electrostatic latent image of magenta (M) is formed without being electrically affected by a charged object such as an ion so that an image quality equivalent to that of the electrostatic latent image of yellow (Y) directly formed on the photoconductive drum 12 can be maintained. Further, since the carrier liquid is also reduced in the image area, a quantity of the free phase ion is also reduced, and the free phase ion is substantially trapped in the toner particles even if the free phase ion exists, which hardly affects formation of the electrostatic latent image of magenta (M). Therefore, the image quantity of the magenta toner image developed with supply of the magenta toner becomes equivalent to the image quality of the yellow toner image.

Then, with movement of the development unit moving mechanism 18*b* in a direction indicated by the arrow t by control of the development unit driving section 18*c*, the development device 32M of magenta (M) is caused to face a development position, and the electrostatic latent image of magenta (M) exposed on the yellow toner image on the photoconductive drum 12 is developed by the liquid developer 18M of magenta.

Subsequently, the toner image of magenta (M) is formed into a thin layer by the squeeze device 21, thereby forming the toner image of magenta (M) on the toner image of yellow (Y).

Thereafter, likewise, a toner image of cyan (C) is superimposed and formed on the toner images of yellow (Y) and magenta (M). That is, at a step of forming the toner image of cyan (C), the carrier liquid in the precedent toner images of yellow (Y) and magenta (M) is reduced by the carrier liquid absorbing device 27 after charging by the charging device 13. Then, the photoconductive drum 12 is selectively irradiated with exposure light modulated based on image information of cyan (C) by the exposure device 17 to form an electrostatic latent image of cyan (C), and then development is carried out by using the liquid developer 18C of cyan (C).

Subsequently, at a step of forming a toner image of black (BK), the carrier liquid in the precedent toner images is reduced by the carrier liquid absorbing device 27 after charging by the charging device 13, and then the photoconductive drum 12 is selectively irradiated with exposure light modulated based on image information of black (BK), thereby forming an electrostatic latent image of black (BK). Then, a BK toner image is formed through a development step using the liquid developer 18BK of black (BK).

In this manner, the toner images of four colors, i.e., yellow (Y), magenta (M), cyan (C) and black (BK) are sequentially superimposed on the surface of the photoconductive drum 12, thereby forming a color toner image.

Then, the carrier liquid is appropriately dried by the drying device 21, a predetermined quantity of the carrier liquid is removed, and then the color toner image on the photoconductive drum 12 is collectively transferred onto the paper sheet P.

In detail, after forming the color toner image on the photoconductive drum 12, the intermediate transfer roller 22 of the transfer device 25 is pressed against the photoconductive drum 12 so that the color toner image on the photoconductive drum 12 is collectively primarily transferred onto the intermediate transfer roller 22 with an effect of pressure. Then, the color toner image is collectively secondarily transferred onto the paper sheet P guided in a direction indicated by an arrow w between the intermediate transfer roller 22 and the pressure roller 23 with effects of the pressure and the heat.

After end of transfer, the transfer residual toner on the surface of the photoconductive drum 12 is removed by the photoconductor cleaner 24, and the residual charge on the surface of the photoconductive drum 12 is eliminated by the charge removing device 26, thereby terminating the series of image forming processes.

The thus obtained color toner image can have clear contrast while the toner images of the second and subsequent colors are not affected by the free phase ion due to the precedent toner image, and the clear contrast, a high definition and a high grade image-quality can be provided without distorting the precedent toner image when reducing the carrier liquid in order to remove the free phase ion.

Incidentally, it is needless to say that a liquid component hardly remains on the photoconductor subjected to the steps of drying and transferring the color toner image and cleaning the photoconductor as described above, and hence the operation of the carrier liquid absorbing device 27 is not necessarily required in formation of an image of the first color in the next image forming process.

With such a configuration, in case of outputting superimposed toner images to an output medium in one transfer process, the carrier liquid on the photoconductive drum 12 can be reduced by the carrier liquid absorbing device 27 after performing charging from the upper side of a precedently formed image by the charging device 13. Therefore, the free phase ion contained in the carrier liquid can be removed. As a result, a subsequent electrostatic latent image formed by the exposure device 17 can obtain an excellent toner image with high contrast without lowering an electrical resistance due to the ion to deteriorate an image quality before development by the development device 18.

It is to be noted that a toner image formed at the precedent step before reducing the carrier liquid by the carrier liquid absorbing device 27 is caused to adhere to the surface of the photoconductive drum 12 with strength equal to or higher than a given value by a strong electric field force (as a charging step in order to form a latent image of the next color) caused by the charging device 13, and hence this image can be substantially prevented from being destroyed (damaged) by the carrier liquid absorbing device 27. Therefore, the precedent toner image is not distorted by the carrier liquid absorbing device 27, and all the toner images superimposed on the photoconductive drum 12 can be formed with high contrast and definition, thereby obtaining a high-quality color toner image having high image dot reproducibility. Further, since set charging of the precedent toner image is carried out by using the charting device 13 before absorbing the carrier liquid by the carrier liquid absorbing device 27, a device for set charging is not required, thus saving an energy. This is also useful for a reduction in a space of the apparatus.

Another embodiment of the image forming apparatus depicted in FIGS. 1 and 2 will now be described with reference to FIG. 3. It is to be noted that the image forming apparatus shown in FIG. 3 is different from the image forming apparatus depicted in FIGS. 1 and 2 in a configuration of a carrier liquid quantity reducing device, but any other elements are the same, and hence like reference numerals denote the same elements, thereby eliminating their detailed explanation.

Figure 3:
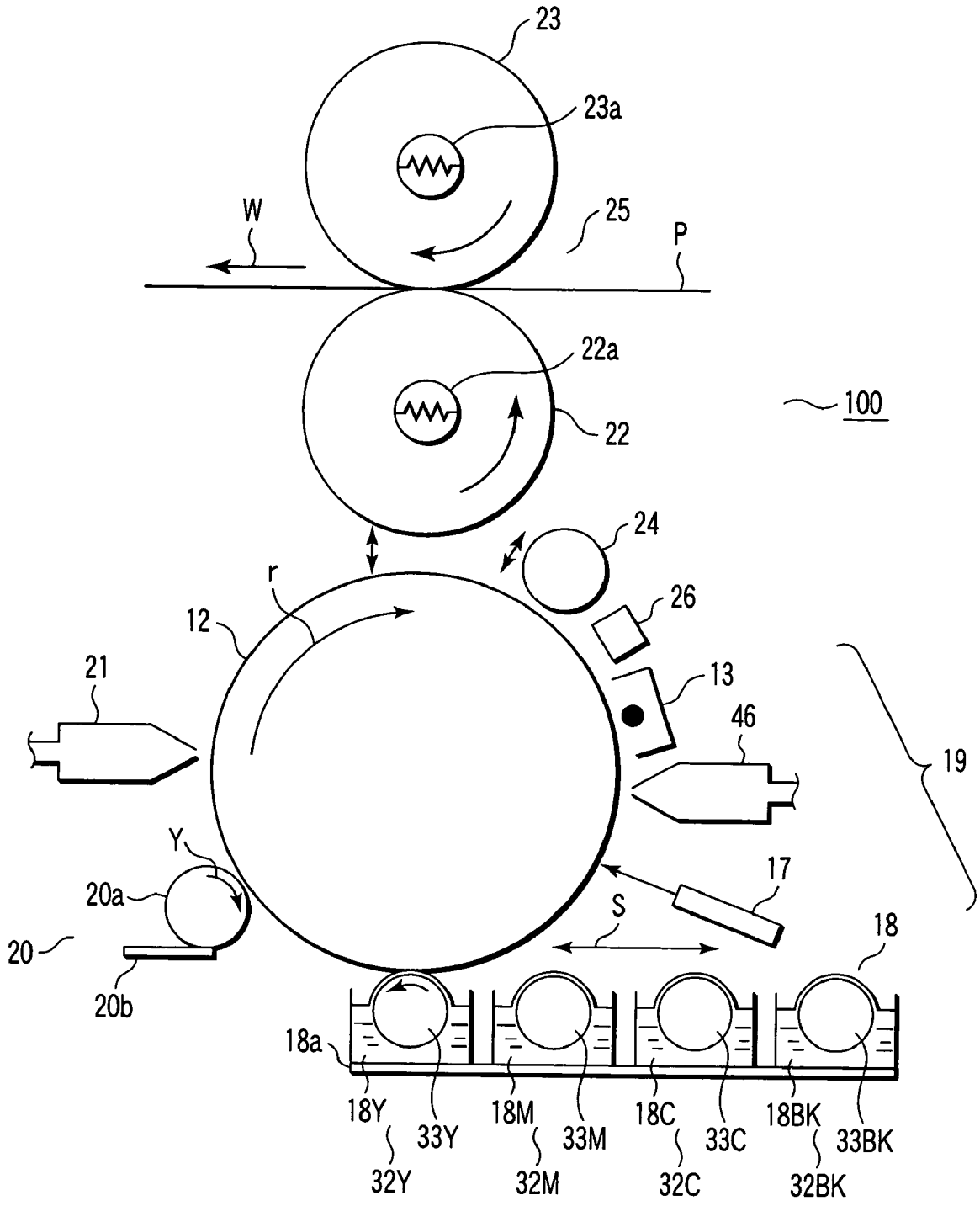
FIG. 3 is a schematic view showing another example of the image forming section in the color electrophotographic apparatus.

An image forming apparatus 100 shown in FIG. 3 is characterized in that a blower device 46 is provided as a carrier liquid quantity reducing device between a charging device 13 and an exposure device 17.

The blower device 46 blows air having a flow velocity higher than a predetermined velocity onto a surface of a photoconductive drum 12.

The blower device 46 supplies high-speed air after set-charging a toner image precedently formed (on the surface of the photoconductive drum 12) by using the charging device 13 so that a carrier liquid contained in the toner image can be discharged in a direction of both ends of the photoconductive drum 12 or an upstream direction or evaporation of the carrier liquid can be facilitated.

As a result, a quantity of the carrier liquid contained in the toner image can be reduced, thereby removing a free phase ion which may possibly remain in the carrier liquid with the precedent toner image.

When the carrier liquid is discharged in the direction of the both ends of the photoconductive drum 12 or the upstream direction by the blower device 46, it is good enough to absorb or remove the carrier liquid in a non-image forming region by a non-illustrated absorbing member or the like.

Then, electrostatic latent images of second and subsequent colors are formed by the exposure device 17, and liquid developers 18M to 18BK are supplied by a development device 18, thereby forming toner images of second and subsequent colors on the precedent toner image in a superimposing manner.

At the time of exposure of the second and subsequent colors, since the free phase ion on the photoconductive drum 12 is substantially removed, the electrostatic latent images of the second and subsequent colors can be formed without being electrically affected by a charged object such as an ion.

Further, since the precedent toner image is set-charged by the charging device 13 prior to a reduction in the carrier liquid by the blower device 46 which is used to remove the free phase ion, the toner image is not distorted as described above.

As mentioned above, charging is performed by the charging device 13 from the upper side of the precedently formed toner image, and then the carrier liquid on the photoconductive drum 12 is reduced by the blower device 46, thereby removing the free phase ion.

As a result, like the example of using the carrier liquid absorbing device 27 in FIGS. 1 and 2 described above, the subsequent electrostatic latent images formed by the exposure device 17 at subsequent steps can obtain high-quality toner images with high contrast without lowering an electrical resistance due to the ion to deteriorate an image quality before development by the development device 18.

Moreover, when reducing the carrier liquid, since the precedent toner image is caused to adhere to the surface of the photoconductive drum 12 with strength equal to or higher than a given value by a strong electric field force (as the charging step in order to form a latent image of the next color) by the charging device 13, the toner image can be substantially prevented from being destroyed (damaged) by the carrier liquid absorbing device 27.

It is to be noted that the blower device 46 does not come into contact with the surface of the photoconductive drum 12, and hence the toner particles of the precedent toner image are not scraped off at all when reducing the carrier liquid. Therefore, all the toner images superimposed on the photoconductive drum 12 can be formed with high contrast and definition, thereby obtaining a high-quality color toner image with high image dot reproducibility.

Additionally, since the charging device 13 is also used as a set charger for a precedent toner image, a device for set charging is not required, thereby saving an energy and a space.

Still another embodiment of the image forming apparatus depicted in FIGS. 1 and 2 and the image forming apparatus shown in FIG. 3 will now be described with reference to FIG. 4.

Figure 4:
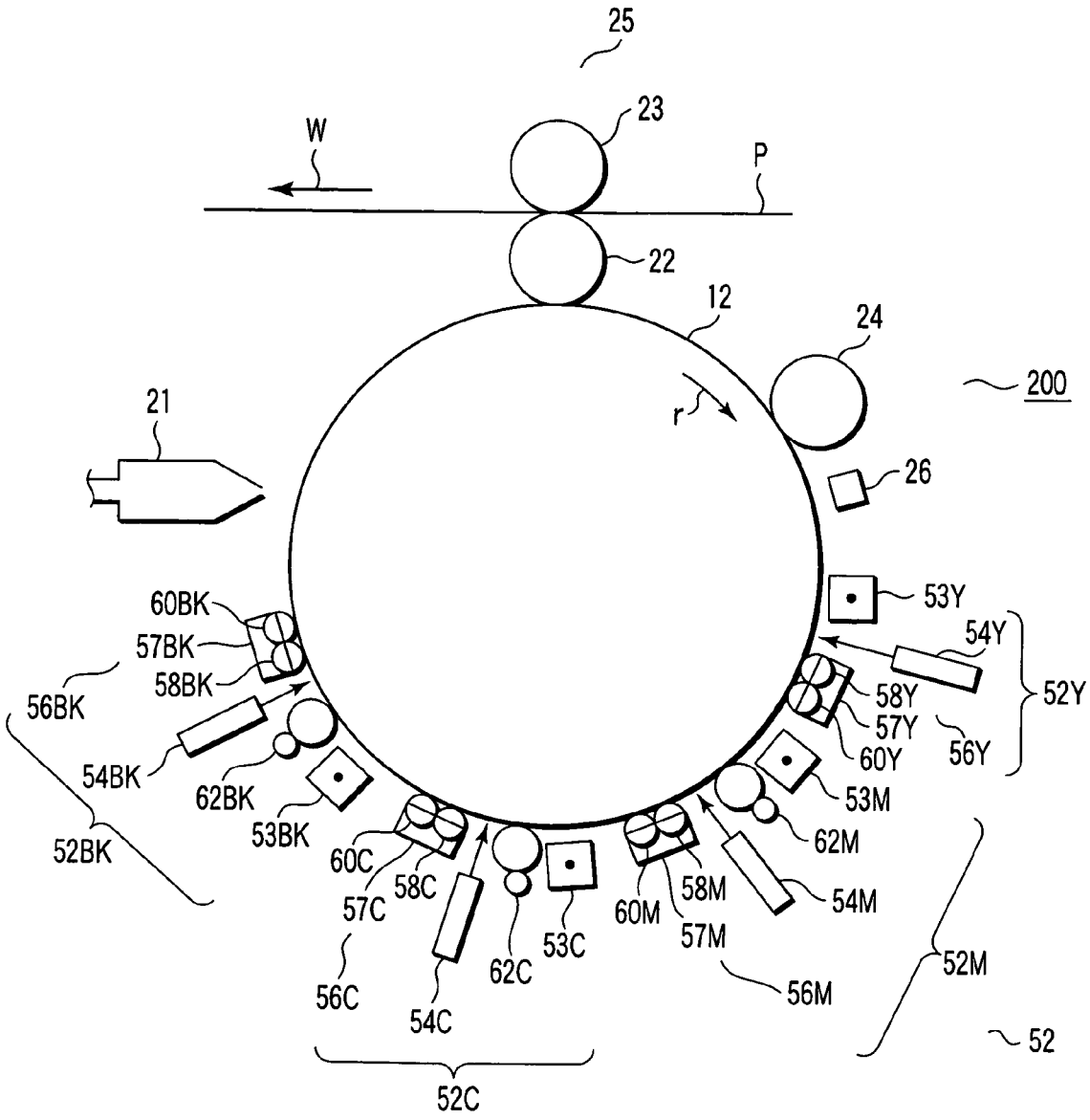
FIG. 4 is a schematic view showing still another example of the image forming section in the color electrophotographic apparatus.

It is to be noted that an image forming apparatus 200 shown in FIG. 4 is characterized by having around a photoconductive drum 12 an image forming unit 52 which has toner image forming sections 52Y to 52BK in four stages (four rows) which form four toner images by using respective liquid developers of yellow (Y), magenta (M), cyan (C) and black (BK). Further, in the image forming apparatus 200, four toner images of yellow (Y), magenta (M), cyan (C) and black (BK) are sequentially superimposed on the photoconductive drum 12 to obtain a color toner image in one revolution of the photoconductive drum 12, and like reference numerals denote structures (elements) equal to those of the above-described image forming apparatuses, thereby eliminating their detailed explanation.

The respective toner image forming sections 52Y to 52BK of the image forming unit 52 have charging devices 53Y to 53BK, exposure devices 54Y to 54BK and development devices 56Y to 56BK in accordance with respective colors along revolutions of the photoconductive drum 12 in a direction indicated by an arrow r.

The exposure devices 54Y to 54BK may be exposure devices which are respectively arranged in the toner image forming sections 52Y to 52BK, or may be one, for example, laser exposure device which is shared between the respective exposure devices 54Y to 54BK.

The development devices 56Y to 56BK have development rollers 58Y to 58BK which supply liquid developers 57Y to 57BK of respective colors to the photoconductive drum 12, and squeeze rollers 60Y to 60BK which form toner images as thin layers.

It is to be noted that carrier liquid absorbing devices 62M, 62C and 62BK which are carrier liquid quantity reducing devices and have porous absorbing rollers are respectively provided on the downstream side of the charging devices 53M, 53C and 53BK of magenta (M), cyan (C) and black (BK). The carrier liquid absorbing devices 62M, 62C and 62BK are brought into contact with the surface of the photoconductive drum 12 to absorb and remove the carrier liquid of a toner image precedently formed on the surface of the photoconductive drum 12.

With a revolution of the photoconductive drum 12 in the direction indicated by the arrow r provoked by start of an image forming process, the photoconductive drum 12 is first uniformly charged by the charging device 53Y in the image forming unit 52Y of yellow (Y), and then selectively irradiated with light from the exposure device 54Y so that an electrostatic latent image of yellow (Y) is formed thereon. Subsequently, the liquid developer 57Y is supplied to the electrostatic latent image on the photoconductive drum 12 by the development roller 58Y of the development device 56Y, and this latent image is formed as a thin layer by the squeeze roller 60Y, thereby obtaining a toner image of yellow (Y) on the photoconductive drum 12.

Thereafter, likewise, toner images of magenta (M), cyan (C) and black (BK) are sequentially superimposed on the surface of the photoconductive drum 12 by the subsequent image forming units 52M to 52BK, thus forming a color toner image.

However, in case of sequentially superimposing the toner images of the second and subsequent colors on the precedently formed toner image, a quantity of the carrier liquid in the precedent toner image is reduced after charging, and the next image information is exposed. That is, after performing uniform charging from the upper side of the toner image of yellow (Y) by the charging device 53M, the carrier liquid is removed by the carrier liquid absorbing device 62 to eliminate the free phase ion, and then the exposure light is applied by the exposure device 54M, thereby forming an electrostatic latent image of magenta (M).

At the time of exposure, since the free phase ion is substantially removed, the electrostatic latent image of magenta (M) is not electrically affected by the ion. Thereafter, in regard to exposure of cyan (C) and black (BK), likewise, after performing charging using the charging device 53C or 53BK, the carrier liquid is removed by the carrier liquid absorbing devices 62C and 62BK to eliminate the free phase ion, and then the exposure light is applied.

After superimposing the toner images of the four colors, i.e., yellow (Y), magenta (M), cyan (C) and black (BK) on the surface of the photoconductive drum 12 to obtain a color toner image in this manner, like the image forming apparatus described above, the carrier liquid is appropriately dried and removed by a drying device 21, and then the color toner image on the photoconductive drum 12 is collectively transferred onto a paper sheet P by a transfer device 25 through an intermediate transfer roller 22 with a pressure and heat.

Thereafter, the transfer residual toner on the surface of the photoconductive drum 12 is removed by a photoconductor cleaner 24, and residual electric charge on the surface of the photoconductive drum 12 is eliminated by a charge removing device 26, thereby terminating the series of image forming processes.

With such a configuration, after forming the precedent toner image, the carrier liquid in the precedent toner image on the photoconductive drum 12 can be reduced by the carrier liquid absorbing devices 62M, 62C and 62BK after charging by the charging devices 53Y to 53BK in the respective toner image forming processes of the second and subsequent colors. As a result, the free phase ion can be removed.

Therefore, like the other image forming apparatuses mentioned above, image qualities of the subsequent electrostatic latent images formed by the exposure devices 54M to 54BK are not deteriorated due to a reduction in an electrical resistance by the ion before development by the development devices 56M to 56BK, thereby obtaining the toner images with high contrast and quality.

It is to be noted that the precedent toner image is not distorted because of set charging using the charging devices 53M to 53BK when reducing the carrier liquid, and all the toner images superimposed on the photoconductive drum 12 can be formed with high contrast and high definition, thus obtaining a high-quality color toner image with high image dot reproducibility.

Furthermore, since the charging devices 53M to 53BK are also used as set charges for the precedent toner image, without a device for set charging is arranged, thereby saving an energy and a space.

In particular, in this image forming apparatus shown in FIG. 4, since the toner image forming sections 52Y to 52BK which hold the liquid developers of the respective colors therein are provided around the photoconductive drum 12 in such a manner that a color toner image is formed on the photoconductive drum 12 while one revolution of the photoconductive drum 12, an energy can be further effectively saved and an installation space can be decreased to reduce the apparatus in size by using the charging devices 53M to 53BK to also serve as set chargers in the toner image forming sections 52M to 52BK of the second and subsequent colors.

Figure 5:
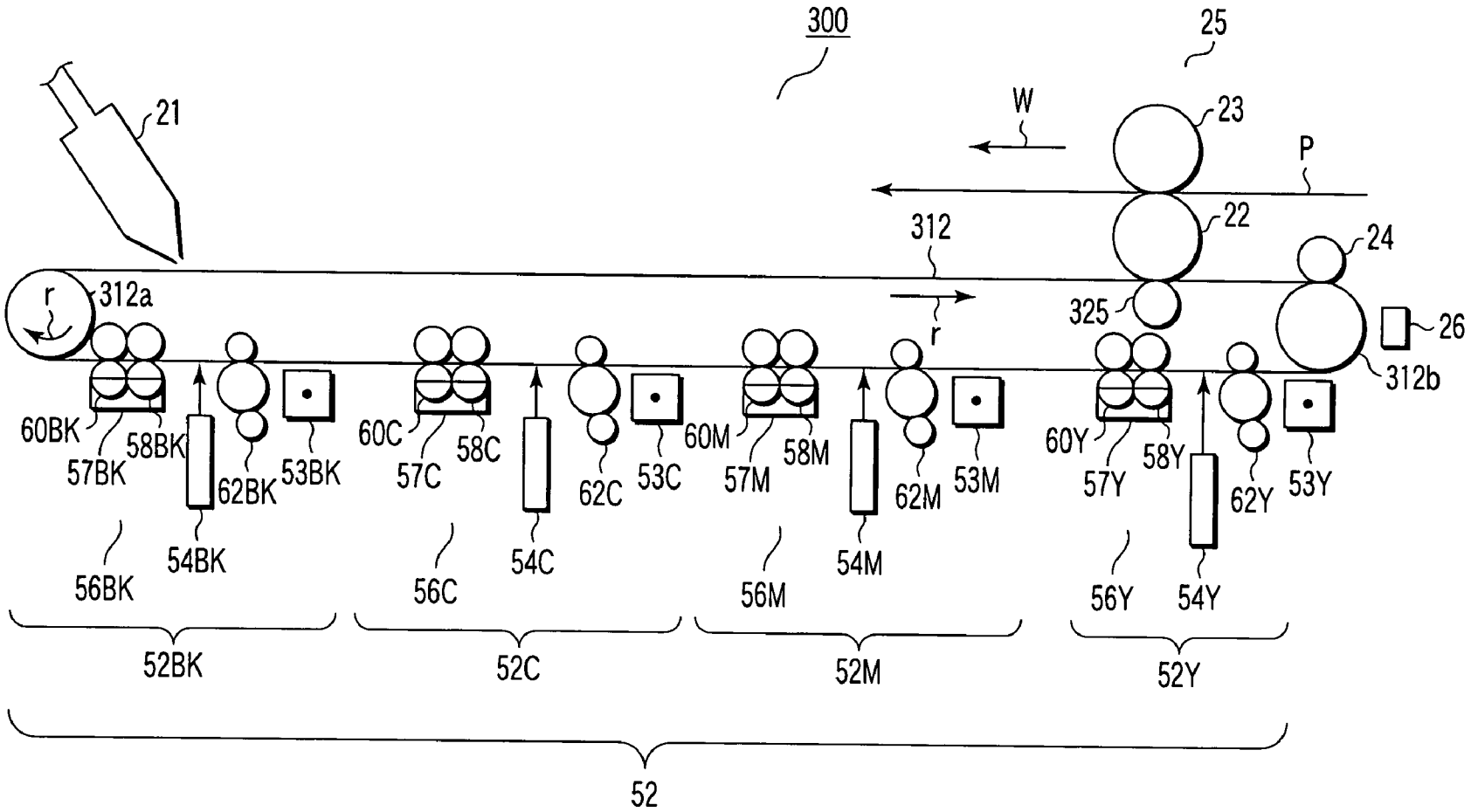
FIG. 5 is a schematic view showing yet another example of the image forming section in the color electrophotographic apparatus.

FIG. 5 shows yet another embodiment of the image forming apparatus using an image forming unit having the toner image forming sections 52Y to 52BK in four stages (four rows) depicted in FIG. 4.

The image forming apparatus 300 shown in FIG. 5 has the belt-shaped photoconductor 312 whose belt surface facing the image forming unit 52 is moved in a direction indicated by the arrow r when the photoconductor 312 is wound around a drive roller 312*a* which is connected with a non-illustrated driving device and rotated with a predetermined number of revolutions and a tension roller 312*b* and the drive roller 312*a* is rotated in the direction indicated by the arrow r.

It is to be noted that an image forming apparatus 300 shown in FIG. 5 is characterized in that a photoconductor 312 having a photoconductive layer has a belt-like shape and that an image forming unit 52 having toner image forming sections 52Y to 52BK in four stages (four rows) which form four toner images by using respective liquid developers of yellow (Y), magenta (M), cyan (C) and black (BK) is arranged along the belt-shaped photoconductor 312. Further, in the image forming apparatus 300, four toner images of yellow (Y), magenta (M), cyan (C) and black (BK) are sequentially superimposed on the photoconductor 312 to obtain a color toner image during one revolution of the photoconductor 312, and like reference numerals denote structures (elements) equal to those in the image forming apparatus described with reference to FIG. 4, thereby eliminating their detailed explanation.

The respective toner image forming sections 52Y to 52BK of the image forming unit 52 have charging devices 53Y to 53BK, exposure devices 54Y to 54BK and development devices 56Y to 56BK in accordance with respective colors along revolutions of the photoconductor 312 in a direction indicated by the arrow r.

The exposure devices 54Y to 54BK may be LED exposure devices which are respectively arranged in, e.g., the toner image forming sections 52Y to 52BK, or may be one laser exposure device which is shared between the respective exposure devices 54Y to 54BK.

The development devices 56Y to 56BK have development rollers 58Y to 58BK which supply liquid developers 57Y to 57BK of respective colors to the photoconductor 312, and squeeze rollers 60Y to 60BK which form toner images as thin layers.

It is to be noted that carrier liquid absorbing devices 62M, 62C and 62BK which are carrier liquid quantity reducing devices and have porous absorbing rollers are respectively provided on the downstream side of the charging devices 53M, 53C and 53BK of magenta (M), cyan (C) and black (BK). The carrier liquid absorbing devices 62M, 62C and 62BK are brought into contact with the surface of the photoconductor 312 to absorb and remove the carrier liquid of a toner image precedently formed on the surface of the photoconductor 312.

With a revolution of the photoconductor 312 in the direction indicated by the arrow r provoked by start of an image forming process, the photoconductor 312 is first uniformly charged by the charging device 53Y in the image forming unit 52Y of yellow (Y), and then selectively irradiated with light from the exposure device 54Y so that an electrostatic latent image of yellow (Y) is formed thereon. Subsequently, the liquid developer 57Y is supplied to the electrostatic latent image on the photoconductor 312 by the development roller 58Y of the development device 56Y, and this latent image is formed as a thin layer by the squeeze roller 60Y, thereby obtaining a toner image of yellow (Y) on the photoconductor 312.

Thereafter, likewise, toner images of magenta (M), cyan (C) and black (BK) are sequentially superimposed on the surface of the photoconductor 312 by the subsequent image forming units 52M to 52BK, thus forming a color toner image.

However, in case of sequentially superimposing the toner images of the second and subsequent colors on the precedently formed toner image, a quantity of the carrier liquid in the precedent toner image is reduced after charging, and the next image information is exposed. That is, after performing uniform charging from the upper side of the toner image of yellow (Y) by the charging device 53M, the carrier liquid is removed by the carrier liquid absorbing device 62 to eliminate the free phase ion, and then the exposure light is applied by the exposure device 54M, thereby forming an electrostatic latent image of magenta (M).

At the time of exposure, since the free phase ion is substantially removed, the electrostatic latent image of magenta (M) is not electrically affected by the ion. Thereafter, in regard to exposure of cyan (C) and black (BK), likewise, after performing charging using the charging device 53C or 53BK, the carrier liquid is removed by the carrier liquid absorbing devices 62C and 62BK to eliminate the free phase ion, and then the exposure light is applied.

After superimposing the toner images of the four colors, i.e., yellow (Y), magenta (M), cyan (C) and black (BK) on the surface of the photoconductor 312 to obtain a color toner image in this manner, like the image forming apparatus described above, the carrier liquid is appropriately dried and removed by a drying device 21, and then the color toner image on the photoconductor 312 is collectively transferred onto a paper sheet P by a transfer device 25 through an intermediate transfer roller 22 with a pressure and heat.

The transfer device 25 has a back up roller 325 contact with an inner side of the photoconductor 312 and pressurizing the intermediate transfer roller 22 with predetermined pressure through the photoconductor 312.

Thereafter, the transfer residual toner on the surface of the photoconductor 312 is removed by a photoconductor cleaner 24, and residual electric charge on the surface of the photoconductor 312 is eliminated by a charge removing device 26, thereby terminating the series of image forming processes.

With such a configuration, after forming the precedent toner image, the carrier liquid in the precedent toner image on the photoconductor 312 can be reduced by the carrier liquid absorbing devices 62M, 62C and 62BK after charging by the charging devices 53Y to 53BK in the respective toner image forming processes of the second and subsequent colors. As a result, the free phase ion can be removed.

Therefore, like the other image forming apparatuses mentioned above, image qualities of the subsequent electrostatic latent images formed by the exposure devices 54M to 54BK are not deteriorated due to a reduction in an electrical resistance by the ion before development by the development devices 56M to 56BK, thereby obtaining the toner images with high contrast and quality.

It is to be noted that the precedent toner image is not distorted because of set charging using the charging devices 53M to 53BK when reducing the carrier liquid, and all the toner images superimposed on the photoconductor 312 can be formed with high contrast and high definition, thus obtaining a high-quality color toner image with high image dot reproducibility.

Furthermore, since the charging devices 53M to 53BK are also used as set charges for the precedent toner image, a device for set charging is not required, thereby saving energy and a space.

In particular, in this image forming apparatus shown in FIG. 5, since the toner image forming sections 52Y to 52BK which hold the liquid developers of the respective colors therein are provided around the photoconductor 312 in such a manner that a color toner image is formed on the photoconductor 312 during one revolution of the photoconductor 312 in one direction, an energy can be further effectively shaved and an installation space can be decreased to achieve a reduction in size of the apparatus by using the charging devices 53M to 53BK to serve as set charges in the toner image forming sections 52M to 52BK of the second and subsequent colors.

It is to be noted that the present invention are not restricted to the above-described various embodiments, and its design can be modified in many ways. For example, there is no problem if the carrier liquid quantity reducing device is arranged between the charging device and the exposure device, but it is preferable to arrange the carrier liquid quantity reducing device at a position closer to the charging device in order to decrease an adverse impact of the free phase ion as much as possible.

For example, a voltage which should be applied to the surface of the absorbing roller of the carrier liquid absorbing device is not restricted in particular, and an arbitrary voltage can be used as long as a charging potential of the photoconductor is not adversely affected irrespective of contact of the absorbing roller.

Furthermore, the image forming apparatus may have an arbitrary configuration as long as toner images of a plurality of colors are superimposed on the photoconductive layer of the photoconductor and then collectively transferred onto the recording medium, and the colors of the toner images, the number of the toner images to be superimposed and others are not restricted. Moreover, the toner images on the image supporting member may be directly transferred onto a paper sheet or the like without using the intermediate transfer roller.

Additionally, the transfer method may be based on an electric filed (a static electric field), e.g., electrophoresis or the like instead of using a pressure and heat.

Further, the plurality of drying devices which dry the toner images before collectively transferring the toner images may be provided, or the drying device is not necessarily required in case of transferring the toner images based on the electrophoresis.

According to the present invention, since the carrier liquid on the photoconductor is reduced after performing charging for formation of images of second and subsequent colors from the upper side of a precedently developed and formed toner image, the free phase ion can be eliminated without distorting the precedent toner image, contrast cannot be deteriorated even in a background part at a subsequent electrostatic latent image forming step, and an excellent electrostatic latent image and hence a high-grade color toner image with high image dot reproducibility can be obtained. Furthermore, since set charging of the precedent toner image can be performed by using the charging device for formation of images of the second and subsequent colors, thereby saving energy and reducing the apparatus in size.

What is claimed is:

1. A color image forming apparatus comprising:

an image supporting member which includes a photoconductive layer configured to hold an electrostatic latent image;

a first image forming section, arranged around the image supporting member, which forms and visualizes an electrostatic latent image on the photoconductive layer to form a first developed image, the first image forming section having a charging device which gives a first potential to the photoconductive layer, an exposure device which forms a first electrostatic latent image corresponding to an image of a first color on the photoconductive layer, and a development device which supplies a developer of the first color to the first electrostatic latent image to form a first developed image;

a second image forming section, arranged around the image supporting member, which forms and visualizes an electrostatic latent image formed on the photoconductive layer to form a second developed image, the second image forming section having a charging device which gives a second potential to the photoconductive layer, the charging device electrostatically fixing the developer of the first color to the photoconductive layer and applying potential to the photoconductive layer so as to form a second electrostatic latent image to the photoconductive layer, an exposure device which forms the second electrostatic latent image corresponding to an image of a second color on the photoconductive layer, and a development device which supplies a developer of the second color to the second electrostatic latent image to form a second developed image at least partially overlapping the first developed image; and a carrier liquid quantity reducing device which is arranged around the image supporting member, and removes part of a carrier liquid contained in the first developed image formed by the first image forming section after a second charging with the charging device of the second image forming section and before the second developed image is formed by the second image forming section.

2. The color image forming apparatus according to claim 1, wherein the second image forming section removes the carrier liquid supplied by the first image forming section, during second and subsequent revolutions of the image supporting member after the first developed image is formed by the first image forming section.

3. The color image forming apparatus according to claim 1, wherein the carrier liquid quantity reducing device includes a roller member formed to selectively come into contact with a surface of the image supporting member.

4. The color image forming apparatus according to claim 1, wherein the carrier liquid quantity reducing device includes a blower device which provides an air current to a surface of the image supporting member.

5. The color image forming apparatus according to claim 4, wherein the blower device does not come into contact with the surface of the image supporting member.

6. The color image forming apparatus according to claim 1, wherein the charging device and the exposure device are configured to be shared in the second image forming section and the first image forming section.

7. A color image forming apparatus which forms a second toner image on a first toner image formed on an image supporting member in a superimposing manner by using a liquid carrier containing toner particles and a carrier liquid, comprising:

a charging device which charges a surface of the image supporting member on which the first toner image is formed, and the charging device preventing the first toner image from being damaged, and applying potential to the image supporting member so as to form the second toner image on the image supporting member;

a carrier liquid quantity reducing device which reduces the carrier liquid on the charged surface of the image supporting member; and an image forming unit which includes an exposure device and a development device, the exposure device forming an electrostatic latent image on the surface of the image supporting member from which the carrier liquid is reduced, the development device developing the electrostatic latent image to form the second toner image, the carrier liquid quantity reducing device being configured to reduce the carrier liquid from the first toner image before the second toner image is formed.

8. The color image forming apparatus according to claim 7, wherein the image forming unit removes the carrier liquid contained in the first toner image during second and subsequent revolutions of the image supporting member.

9. The color image forming apparatus according to claim 7, wherein the carrier liquid quantity reducing device includes a roller member formed to selectively come into contact with the surface of the image supporting member.

10. The color image forming apparatus according to claim 7, wherein the carrier liquid quantity reducing device includes a roller member formed to selectively come into contact with the surface of the image supporting member.

11. The color image forming apparatus according to claim 7, wherein the charging device and the exposure device are configured to be shared in forming of the second toner image and forming of the first toner image.

12. An image forming method comprising:

charging a surface of an image supporting member;

forming a first electrostatic latent image on the image supporting member;

supplying a first liquid developer containing toner particles and a carrier liquid to the first electrostatic latent image on the image supporting member to form a first toner image;

charging the surface of the image supporting member including the first toner image to electrostatically fix the first toner image on the image supporting member and to form a second electrostatic latent image on the image supporting member;

reducing the carrier liquid in the first toner image on the image supporting member;

forming a second electrostatic latent image on the first toner image on the image supporting member; and supplying a second liquid developer containing toner particles and a carrier liquid to the second electrostatic latent image onto the first toner image to form a second toner image in a superimposing manner after the reducing of the carrier liquid.

13. The image forming method according to claim 12, further comprising:

charging a surface of the image supporting member including the first and second toner images;

forming a second electrostatic latent image on the image supporting member after the charging of the image supporting member including the first and second toner images;

reducing the carrier liquid in the second toner image having a second charging potential given thereto in the charging of the image supporting member including the first and second toner images; and supplying a third liquid developer containing toner particles and a carrier liquid onto the first and second toner images to form a third toner image in a superimposing manner after the reducing of the carrier liquid in the second toner image.

14. The image forming method according to claim 12, wherein the charging is performed at a point on the surface of the image supporting member.

* * * * *